United States Patent [19]

Sumiyoshi et al.

[11] 4,253,440

[45] Mar. 3, 1981

[54] FUEL SUPPLY APPARATUS FOR INTERNAL COMBUSTION ENGINES

[75] Inventors: Masaharu Sumiyoshi; Setsuro Sekiya; Katsuhiko Motosugi, all of Toyota; Junzo Uozumi, Nagoya; Tsuneo Ando, Chiryu; Yuzo Takeuchi; Mikio Minoura, both of Nagoya, all of Japan

[73] Assignees: Toyota Jidosha Kogyo Kabushiki Kaisha, Toyota; Aisan Industry Co., Ltd., Ohbu, both of Japan

[21] Appl. No.: 922,852

[22] Filed: Jul. 7, 1978

[30] Foreign Application Priority Data

Jul. 15, 1977 [JP] Japan ..... 52-84847

[51] Int. Cl.[3] ..... F02M 57/04; F02M 57/00

[52] U.S. Cl. ..... 123/442; 123/505

[58] Field of Search ..... 123/139 BG, 139 AW, 123/140 MC; 261/50 A

[56] References Cited

U.S. PATENT DOCUMENTS

| | | | |
|---|---|---|---|
| 3,861,366 | 1/1975 | Masaki | 123/139 AW |
| 3,983,849 | 10/1976 | Stumpp | 123/139 AW |
| 4,058,100 | 11/1977 | Tanaka | 123/139 BG |
| 4,090,487 | 5/1978 | Stumpp | 123/139 AW |
| 4,096,838 | 6/1978 | Tanaka | 123/139 AW |
| 4,143,631 | 3/1979 | Stumpp | 123/139 AW |
| 4,194,478 | 3/1980 | Sumiyoshi | 123/139 AW |

*Primary Examiner*—Charles J. Myhre
*Assistant Examiner*—Carl Stuart Miller
*Attorney, Agent, or Firm*—Cushman, Darby and Cushman

[57] ABSTRACT

A fuel supply apparatus for internal combustion engines of a type including an air valve disposed in an intake conduit of the engine upstream of a throttle valve. A sensor is used for sensing the pressure in an air pressure chamber defined within the intake conduit between the air valve and the throttle valve and a feedback control unit is used for controlling the air valve in response to the pressure sensed by the sensor in order to maintain the pressure in the air pressure chamber at a preset value. A fuel flow metering valve is disposed in a fuel feed channel leading from a source of fuel under pressure to the intake conduit and the metering value is interlocked with the air valve in such a manner that the opening degree of the fuel metering valve is in proportion to that of the air valve. Also a pressure difference control unit is employed for maintaining the pressure difference of fuel across the fuel metering valve at a preset value, whereby the air-fuel ratio of an air-fuel mixture is maintained constant independently of the engine speed. The fuel supply apparatus of the above type further comprises a variable volume chamber defined by a cylinder and a piston slidably disposed within the cylinder and interlocked with the throttle valve. The pressure variation in the variable volume chamber according to operation of the throttle valve for acceleration or deceleration of the engine is transmitted to either the pressure difference control unit or the air valve control unit to correct the preset pressure difference across the fuel metering valve or the preset pressure in the air pressure chamber, whereby the air-fuel ratio is made richer or leaner during acceleration or deceleration of the engine.

5 Claims, 4 Drawing Figures

FUEL SUPPLY APPARATUS FOR INTERNAL COMBUSTION ENGINES

BACKGROUND OF THE INVENTION

1. Field of the Invention

The present invention relates in general to a fuel supply apparatus for an internal combustion engine of fuel injection type. In particular, the invention concerns a fuel supply apparatus of the type in which intake air quantity is detected by an air valve disposed within an intake conduit upstream of a throttle valve and adapted to be so controlled that pressure in a constant pressure chamber defined between the air valve and the throttle valve may be maintained constant, while fuel quantity to be supplied to the internal combustion engine is controlled by a fuel metering assembly interlocked with the air valve so as to be proportional to the intake air quantity.

2. Description of the Prior Art

The prior fuel supply apparatus of the above type includes an intake conduit leading to the engine and having a throttle valve disposed therein, an air valve disposed within the intake conduit upstream of the throttle valve to define an air pressure chamber between the throttle valve and the air valve in the intake conduit, control means for controlling the air valve so as to maintain the pressure prevailing in the air pressure chamber at a preset value, a fuel supply source of a constant pressure for supplying fuel to the intake conduit through a fuel feed channel, a fuel flow metering valve disposed in the fuel feed channel and interlocked with the air valve such that the area of fuel flow section of the fuel flow metering valve is so controlled as to be in proportion to the opening degree of the air valve, and a fuel pressure differential means for maintaining the pressure difference produced across the fuel flow metering valve at a preset value.

In accordance with the prior fuel supply apparatus constructed as mentioned above, the air-fuel mixture may be controlled to have a predetermined air-fuel ratio independent of operating speeds of the internal combustion engine during normal operation mode thereof, whereby purification of exhaust gas from the engine can be accomplished to a reasonable degree. However, difficulties are encountered in controlling the required quantities of fuel in the transient operation modes of the engine such as acceleration and deceleration modes. Further, such transient operations of the engine requires air-fuel ratios different from the one required in the normal steady operation in order to assure satisfactory operation performance and purification of the exhaust gas.

SUMMARY OF THE INVENTION

A primary object of the present invention is to provide a fuel supply apparatus for internal combustion engines which is capable of automatically correcting air-fuel ratio of the combustible mixture supplied to such engines in the transient operation modes thereof with a simplified and inexpensive construction.

To this end according to the present invention the fuel supply apparatus of the above type further comprises pressure signal generating means composed of a cylinder and a piston interlocked with the throttle valve and slidable within the cylinder to define a variable volume chamber therein for generating a pressure signal of a level corresponding to a rate at which the throttle valve is opened or closed, and means acting in response to the level of the pressure signal for correcting either the preset pressure prevailing in the air pressure chamber or the preset pressure difference produced across the fuel flow metering valve during opening or closing operation of the throttle valve.

According to a preferred embodiment of the invention, with a view to varying the preset pressure difference across the fuel flow metering valve, there is proposed to constitute the fuel pressure differential means by a first pressure chamber for receiving the pressure downstream of the fuel flow metering valve, a second pressure chamber maintained at a predetermined pressure and a constant differential pressure valve in the fuel feed channel downstream of the fuel flow metering valve acting in response to the pressure difference between the first and second pressure chambers for controlling the pressure downstream of the fuel flow metering valve so as to maintain the pressure difference between the first and second pressure chambers constant and to communicate the variable volume chamber with the second pressure chamber.

With such an arrangement, the pressure in the second pressure chamber is caused to vary correspondingly in response to the operation of the throttle valve for accelerating or decelerating the engine speed, resulting in the corresponding variation in the pressure difference appearing across the fuel flow metering valve. Consequently, the fuel flow passing through the fuel metering valve is varied, whereby the air-fuel ratio is also correspondingly varied.

According to another embodiment of the invention in which the preset pressure in the air pressure chamber is to be varied in response to the pressure signal, the air pressure valve control means is composed of a pilot valve operated in response to changes in pressure within the air pressure chamber, fluid actuator means operated through fluid pressure controlled by the pilot valve for controlling the air valve so as to cancel the deviation of pressure within the air pressure chamber from the preset pressure, and a pilot pressure chamber communicated with a constant pressure source for urging the pilot valve toward one direction, wherein the variable volume chamber is communicated with pilot pressure chamber.

With the arrangement as just described above, the pressure in the pilot pressure chamber is caused to vary in response to the operation of the throttle valve thereby to vary the opening degree of the air valve, as the result of which the intake air quantity and hence the air-fuel ratio are varied correspondingly.

In this manner, the fuel concentration of the air-fuel mixture is automatically increased during the engine operation in the acceleration mode, while the fuel concentration is decreased in the deceleration mode.

The above and other objects, novel features and advantages of the invention will become more apparent from the description on exemplary embodiments of the invention taken in conjunction with the accompanying drawings.

DETAILED DESCRIPTION OF THE PREFERRED EMBODIMENTS

Figure 1:
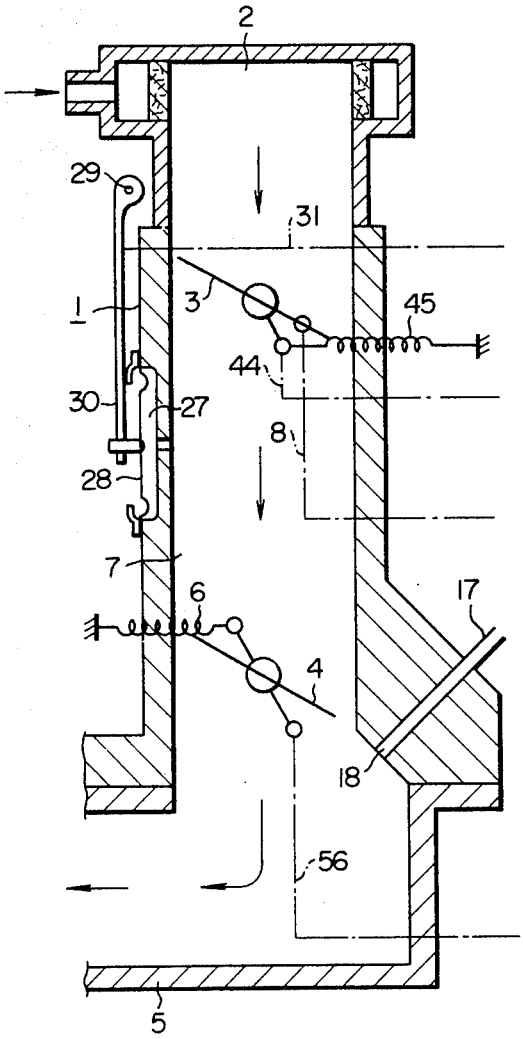
FIG. 1 is a sectional view showing schematically an air intake portion of an internal combustion engine to be combined with a fuel supply apparatus according to the invention.

Referring to FIG. 1 which shows in a sectional view an intake conduit portion of an internal combustion engine provided with a fuel supply apparatus according to an embodiment of the invention, reference numeral 1 denotes a main body of the apparatus which includes an air cleaner 2 mounted at the top inlet port thereof as well as an air valve 3 and a throttle valve 4 disposed therein. Air as sucked through the air cleaner 2 passes through the air valve 3 and the throttle valve 4 to an intake conduit 5 and hence fed to the engine cylinders through intake ports (not shown). The throttle valve 4 is usually biased toward the closing position under the action of a spring 6 and adapted to control the intake air flow through angular displacement thereof as caused by corresponding actuation of an acceleration pedal (not shown), as is well known in the art. On the other hand, the direction in which the air valve 3 is rotated depends on the quantity of intake air, i.e. the air valve 3 is rotated in the opening direction as the intake air flow is increased, while the valve 3 is rotated in the closing direction as the intake air flow is decreased. The angular position taken by the air valve 3 is controlled by a feedback control apparatus described hereinafter in such a manner that the depression in an air pressure chamber 7 defined between the air valve 3 and the throttle valve 4 within the main body 1 will remain constant. The air valve 3 is coupled to a fuel metering rod 9' of a fuel metering valve 9 shown in FIG. 2 through a linkage represented by a dotted broken line 8. The fuel metering rod 9' is slidably disposed within a cylinder 10 and adapted to be axially displaced as the air valve 3 is rotated. In this connection, it is to be noted that the connection between the air valve 3 and the fuel metering rod 9' through the coupling linkage 8 is made such that the displacement of the fuel metering rod 9' is proportional to changes in the opening degree of the air valve 3, i.e. change in area of gap defined between the outer periphery of the air valve 3 and the cylindrical inner wall of the main body 1. As can be seen from FIG. 2, the fuel metering rod 9' has an inner end portion 11 located within the cylinder 10 and formed with a counter-bore or hollow portion around the axis thereof. A pair of slits 12 are formed axially in the peripheral wall of the hollow end portion 11 so as to split the latter into two semi-cylindrical halves. An inlet passage 13 which is communicated with a fuel supply source of a constant pressure (a high pressure fuel source 21 described hereinafter) is opened into the cylinder 10 at the closed end thereof. Further, the cylinder 10 is formed with an annular groove 14 in the inner wall into which an outlet passage 15 is opened. With such arrangement, the fuel flowing into the cylinder 10 through the inlet passage 13 will flow through the slits 12 formed in the hollow portion 11 of the fuel metering rod 9' into the annular groove 14 and hence into the outlet passage 15 to be fed out. The slits 12 and the annular groove 14 thus constitute a variable slit having a variable flow section which can be variably set in dependence upon the degree of superposition between the slits 12 and the annular groove 14. In this conjunction, it should be recalled that the fuel metering rod 9' is interlocked with the air valve 3 so that the position of the rod 9' may proportionally depend on the opening degree of the air valve 3. Consequently, the flow section of the variable slit formed by the slits 12 and the annular groove 14 will vary in proportion to variation in the opening degree of the air valve 3. The fuel thus metered through the metering valve 9 flows through the outlet passage 15 to a fuel pressure differential apparatus 16 and hence to a fuel nozzle 18 (FIG. 1) through a fuel passage 17 to be injected into the interior space of the intake conduit 1 downstream of the throttle valve 4. It should be mentioned that the fuel pressure differential apparatus 16 serves to maintain a constant difference in pressure between the upstream and the downstream sides of the fuel metering valve 9 as will be described in detail hereinafter.

Figure 2:
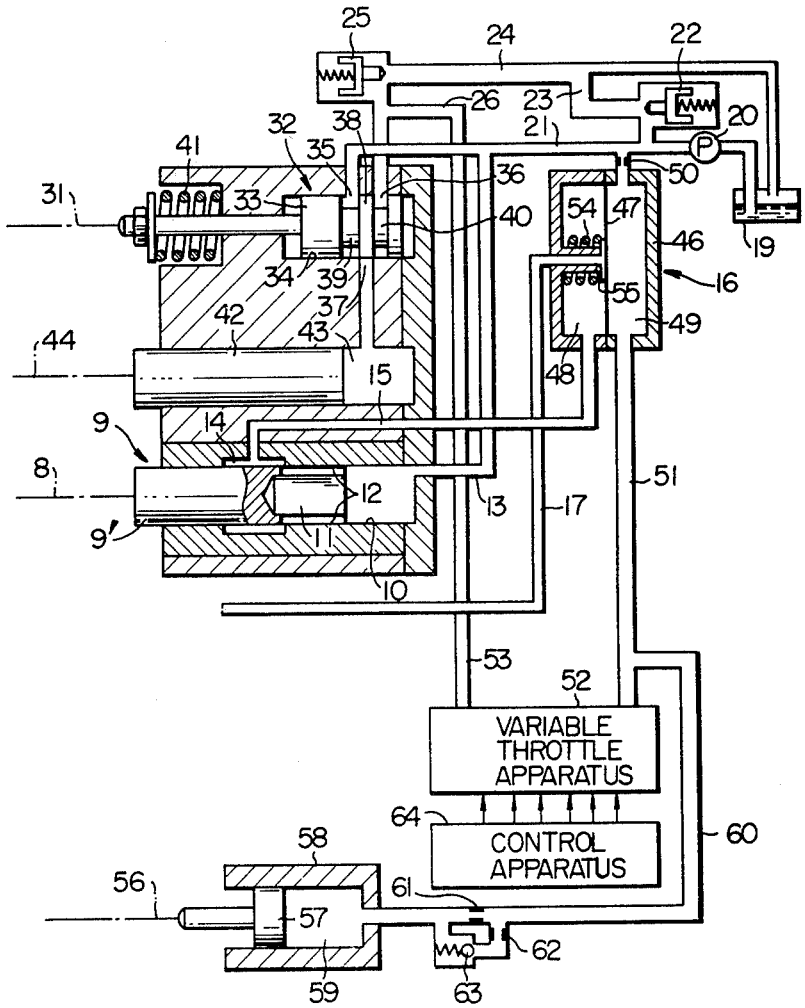
FIG. 2 is a sectional view showing schematically a general arrangement of an embodiment of the fuel supply apparatus according to the invention.

In FIG. 2, the fuel contained in a fuel tank 19 is fed under pressure by means of a fuel pump 20, whereby a portion of the pumped fuel is injected into the interior of the intake conduit 1 from the fuel injection nozzle 18 after having been metered by the fuel metering valve 9. A conduit 21 connected to the discharge side of the fuel pump 20 is communicated with a fuel return passage or conduit 24 through a by-pass conduit 23 provided with a high pressure valve 22, thereby constituting a high pressure fuel source maintained at a high pressure with a constant pressure difference relative to the atmospheric pressure. A low pressure valve 25 is installed in the return conduit 24 upstream of the junction between the return conduit 24 and the by-pass conduit 23, whereby a low pressure fuel source 26 is constituted upstream of the low pressure valve 25 which maintains a constant pressure difference smaller than that of the high pressure fuel source 21 relative to the atmospheric pressure.

As described hereinbefore, the pressure prevailing in the air pressure chamber 7 defined between the air valve 3 and the throttle valve 4 is maintained constant independently of the intake air flow or quantity with the aid of the feedback control system. In a typical embodiment of the feedback control system described below, the fuel from the high pressure fuel source 21 as well as the low pressure fuel source 26 is advantageously utilized for the operation of the control system.

Formed in the outer wall of the main body 1 at location where the air pressure chamber 7 is formed in the interior thereof is a recess 27 which is communicated to the air pressure chamber 7 and covered by a diaphragm 28. An arm 30 pivotally mounted at 29 is attached at its free end to the diaphragm 28 so that variation in pressure within the air pressure chamber 7 may give rise to a pivotal movement of the arm 30 through the diaphragm 28. Thus, the diaphragm 28 functions as a pressure sensor for detecting pressure prevailing in the air pressure chamber 7. The movement of the arm 30 is transmitted to a spool 33 of a pilot valve 32 shown in FIG. 2 through a connecting link represented by a dotted broken line 31. Two ports 35 and 36 are opened in one side of a bore 34 accommodating slidably the spool 33, which ports 35 and 36 are communicated to the high pressure fuel source 21 and the low pressure fuel source 26, respectively. At the side opposite to the ports 35 and 36, there is formed a port 37 in the bore 34 which port 37 is located at a middle position between the ports 35 and 36, as viewed in the axial direction of the bore 34. The spool 33 is further formed with two annular grooves 39 and 40 which are partitioned by a land 38 having a width substantially equal to the diameter of the port 37 and communicated to the ports 35 and 36, respectively. The spool 33 is maintained in a balanced position under the influence of a spring 41 and the force exerted by the arm 30 of the pressure sensor 28 so that the fuel flow from the high pressure fuel source 21 through the port 35 into the port 37 is balanced with the fuel flow from the port 37 into the low pressure fuel source 26 through the port 36 when the pressure within the air pressure chamber 7 is at a preset level. The port 37 is communicated with a cylinder 43 having an air valve drive piston 42 accommodated therein. The air valve drive piston 42 is connected to the air valve 3 through a link represented by a dotted broken line 44. The air valve 3 is usually urged toward the closing position under the action of a tension spring 45.

Assuming for example that the opening degree of the throttle valve 4 is increased with the intake air flow being correspondingly increased during the operation of engine, the pressure in the air pressure chamber 7 will become lower than a preset level. Such reduction in pressure will be detected by the pressure sensor diaphragm 28 and result in movement of the spool 33 through the arm 30 to the right as viewed in the drawing, which in turn involves a correspondingly increased flow section of the fuel constriction passage constituted by the port 37 and the annular groove 39, while the flow section of the constriction passage constituted by the port 37 and the annular groove 40 is simultaneously decreased. Under such conditions, the pressure in the cylinder 43 is increased, as a result of which the drive piston 42 is moved to the left as viewed in the drawing, thereby to rotate the air valve 3 in the opening direction against the force of the spring 45. Consequently, resistance to the air flow through the air valve 3 is decreased. This means that the pressure within the air pressure chamber 7 will be raised again toward the preset level. Such pressure increase will cause the spool 33 to be moved leftwards through the diaphragm 28 and the arm 30, whereby the spool 33 is returned to the neutral position at which the drive piston 42 is stopped thereby to set the air valve at a new opening degree.

On the other hand, when the pressure in the air pressure chamber 7 is increased beyond the preset level by decreasing the opening of the throttle valve 4, the spool 33 is displaced from the neutral position to the left, resulting in a decreased fuel flow into the port 37 from the annular groove 39, while the fuel flow from the port 37 into the annular groove 40 is increased. Consequently, the pressure prevailing in the cylinder 43 is lowered with the piston 42 being moved rightwards under the action of the spring 45 to rotate the air valve 3 in the closing direction. When the pressure within the air pressure chamber 7 is lowered to the preset value, the spool 33 will then be restored to the neutral position with the air valve 3 being set at a reduced opening.

As will be appreciated from the foregoing description, the pressure sensor diaphragm 28, the pilot valve 32 and the air valve drive piston 42 constitute a feedback control circuit which functions to adjust the opening degree of the air valve 3 in such a way that the pressure within the air pressure chamber 7 may be constantly maintained at a preset constant level independently of the intake air quantity. Since the control performance of the feedback control circuit is of an integration nature, no instability will occur even for an abrupt or rapid change in the intake air quantity. Further, delay in response can be relatively reduced because of use of the high pressure fuel as the operating medium. The pressure level set at the air pressure chamber 7 is determined by the balance between the force exerted to the diaphragm 28 and the force of spring 41.

Next, description will be made on the fuel pressure differential apparatus 16 for maintaining the pressure difference of fuel to be constant between the upstream and the downstream sides of the fuel metering valve 9. The fuel pressure differential apparatus 16 includes a housing 46 in which first and second chambers 48 and 49 are formed as partitioned from each other through a diaphragm 47 mounted in the housing 46 in a tensioned state. The second pressure chamber 49 is communicated with the high pressure fuel source 21 through a fixed throttle 50 and at the same time communicated with the low pressure fuel source 26 through a conduit 51, a variable throttle apparatus 52 and a conduit 53. Accordingly, the pressure within the second pressure chamber 49 is maintained at a constant intermediate level between the pressure levels in the high and low pressure fuel sources 21 and 26, so far as the flow resistance of the variable throttle apparatus 52 remains constant. The outlet passage 15 of the fuel metering valve 9 is opened into the first pressure chamber 48 which is thus subjected to the pressure prevailing at the downstream side of the fuel metering valve 9. Furthermore, in the first pressure chamber 48, there is disposed adjacent and in opposition to the diaphragm 47 a valve seat 55 in which the fuel passage 17 extending to the fuel injection nozzle 18 is opened. Additionally, a spring 54 is disposed in such a manner that the diaphragm 47 is so pressed as to be moved away from the valve seat 55. Thus, the diaphragm 47 constitutes together with the valve seat 55 a constant differential pressure valve and is moved toward the valve seat 55 when the difference in pressure between the first and the second pressure chambers 48 and 49 becomes greater than a preset value determined by the force of the spring 45, while the diaphragm 47 is moved away from the valve seat 55 when the difference in pressure between the first and the second pressure chambers 48 and 49 becomes smaller than the preset value, whereby the pressure in the first pressure chamber 48 is maintained at a constant differential pressure relative to the second pressure chamber 49. Thus, the pressure prevailing at the downstream side of the fuel metering valve 9 is maintained to be constant, because the pressure in the first pressure chamber 48 remains constant so far as the pressure in the second pressure chamber 49 is maintained constant. On the other hand, the pressure prevailing at the upstream side of the fuel metering valve 9 is also constant because of direct communication to the high pressure fuel source 21 through the inlet passage 13. In this manner the pressure difference across the fuel metering valve 9 will remain constant, so long as the pressure in the second pressure chamber 49 is constant.

As will be appreciated from the above description, the fuel flow quantity allowed to pass through the fuel metering valve 9 will be in exact proportion to the opening degree of the air valve 3, because the pressure difference across the fuel metering valve 9 is maintained constant by the fuel pressure differential apparatus, 16 and because the flow section of the fuel metering valve 9 is proportional to the opening degree of the air valve 3. On the other hand, the air pressure at the upstream side of the air valve 3 may be regarded to be equal to the atmospheric pressure, while the pressure at the downstream side of the air valve (i.e. pressure in the air pressure chamber 7) is maintained constant through the corresponding control of the air valve 3, as described above. Thus, the quantity of intake air passing through the intake conduit 1 will become exactly proportional to the opening degree of the air valve 3. It will be now understood that the combination of the air valve and the fuel metering valve in such manner as described above will allow the ratio of the fuel supply to the quantity of intake air (i.e. air-fuel ratio) to be maintained at a constant value independently of variations in the intake air quantity.

Now, assuming that the opening degree of the air valve 3 is represented by Aa and pressures at the upstream and the downstream sides of the air valve 3 are represented by Po and Pa, respectively, the intake or suction air flow Ga can be expressed as follows:

$$Ga \propto Aa\sqrt{Po-Pa} \quad (1)$$

On the other hand, if the area of flow section of the fuel metering valve 9 is represented by Af with the pressures at the upstream and downstream sides thereof being represented by Ph and Pc, respectively, the fuel injection quantity Gf can be given by the following expression:

$$Gf \propto Af\sqrt{Ph-Pc} \quad (2)$$

From the expressions (1) and (2), the air-fuel ratio Ga/Gf is given as follows:

$$Ga/Gf \propto (Aa/Af)\cdot(\sqrt{Po-Pa}/\sqrt{Ph-Pc}) \quad (3)$$

Since the air valve control apparatus and the fuel pressure differential apparatus as described above function to maintain the conditions Po−Pa and Ph−Pc to be constant and in addition the air valve 3 is so interlocked with the fuel metering valve 9 that the ratio Aa/Af may be constant, the air-fuel ratio Ga/Gf is maintained constant.

In the fuel supply apparatus of the construction described above, the invention contemplates the decrease of the air-fuel ratio to make the mixture richer in the acceleration mode of the internal combustion engine and the increase of the air-fuel ratio making the mixture leaner in the deceleration mode of the engine by varying either the pressure difference Ph−Pc or Po−Pa. For example, if the pressure difference Ph−Pc is increased by 10% during the acceleration of the engine, the ratio of the normal air-fuel ratio during a steady operation to the air-fuel ratio during the acceleration will become equal to $\sqrt{1.1}$, which means that the fuel concentration is increased about 5%. To the contrary, decrease by 10% of the pressure difference Ph−Pc in the deceleration mode will reduce the fuel concentration about 5%. On the other hand, variation of the pressure difference Po−Pa by ±10% will involve decrease and increase of about 5% in the fuel concentration, respectively.

Next, description will be made on an embodiment of the arrangement for varying the air fuel ratio by varying the pressure difference Ph−Pc upon acceleration and deceleration of the internal combustion engine with further referring to FIG. 2. The acceleration and deceleration of the internal combustion engine are detected by a piston 57 connected to the throttle valve 4 through a link denoted by a dotted-broken line 56. The piston 57 is slidably accommodated in a cylinder 58 thereby to define a variable volume chamber 59 therein which is communicated to the conduit or passage 51 through a conduit 60. There is provided a fixed orifice 61 in the conduit 60 which is connected in parallel with a bypassing series connection of a fixed orifice 62 and a check valve 63.

Assuming now that the throttle valve 4 is being opened to accelerate the engine, the volume of the variable volume chamber 59 is increased due to the corresponding displacement of the piston 57 interlocked to the throttle valve 4, as the result of which a portion of fuel quantity flowing from the second pressure chamber 49 into the low pressure fuel source 26 by way of the conduit 51, the variable throttle apparatus 52 and the conduit 53 is caused to flow into the variable volume chamber 59 through the conduit 60, the fixed orifice 61 as well as the bypassing series connection of the fixed orifice 62 and the check valve 63. Consequently, the pressure in the second pressure chamber 49 is lowered as being concurrently accompanied by a corresponding reduction in pressure in the first pressure chamber 48 maintained at a constant pressure difference relative to the second pressure chamber 49. Since the pressure in the first pressure chamber 48 is equal to the pressure Pc prevailing at the downstream side of the fuel metering valve 9 while the pressure Ph prevailing at the upstream side of the fuel metering valve 9 remains equal to the constant pressure in the high pressure fuel source 21, the difference Ph−Pc is increased to enrich the air-fuel mixture, i.e. increase the concentration of the fuel component only when the volume of the variable volume chamber 59 is being increased for the acceleration of the engine.

On the contrary, in the deceleration mode of the engine operation, the throttle valve 4 is rotated in the closing direction with the volume of the variable volume chamber 59 being simultaneously decreased. Under these conditions, the fuel is caused to flow out from the variable volume chamber 59 to be added to the fuel flow in the conduit 51 through the conduit 60 and the fixed orifice 61, resulting in an increased pressure in the second pressure chamber 49. Consequently, the pressure Pc becomes higher, whereby the pressure difference Ph−Pc is decreased to reduce the fuel concentration. Thus, the air-fuel mixture is made leaner during the rotation of the throttle valve 4 in the closing direction. In this connection, it is noted that the degree of increase or decrease in the fuel concentration of the air-fuel mixture is related to the speed at which the throttle valve is opened or closed, respectively, because the rate of change in the pressure Pc is in proportion to the rate of change in the volume of the variable volume chamber 59.

As will be appreciated from the above discussion, the air-fuel ratio of the combustible mixture supplied to the internal combustion engine can be automatically corrected to optimum values in dependence on the acceleration and deceleration of the engine.

The variable throttle apparatus 52 may be constituted by a plurality of throttle valves which are adapted to be controlled in respect of the respective flow sections by a control apparatus 64 in dependence on changes of various parameters representing environmental and operating conditions of the internal combustion engine such as atmospheric pressure and temperature, engine temperature and the like. With such arrangement, it is possible to perform the optimum control of the air-fuel ratio in accordance with the parameters described above even during the normal steady operation of the engine, because the pressure in the second pressure chamber 49 is effected by corresponding variations in the flow resistances of the individual throttle valves constituting the variable throttle apparatus 52 as brought about by the change of such parameters.

Figure 3:
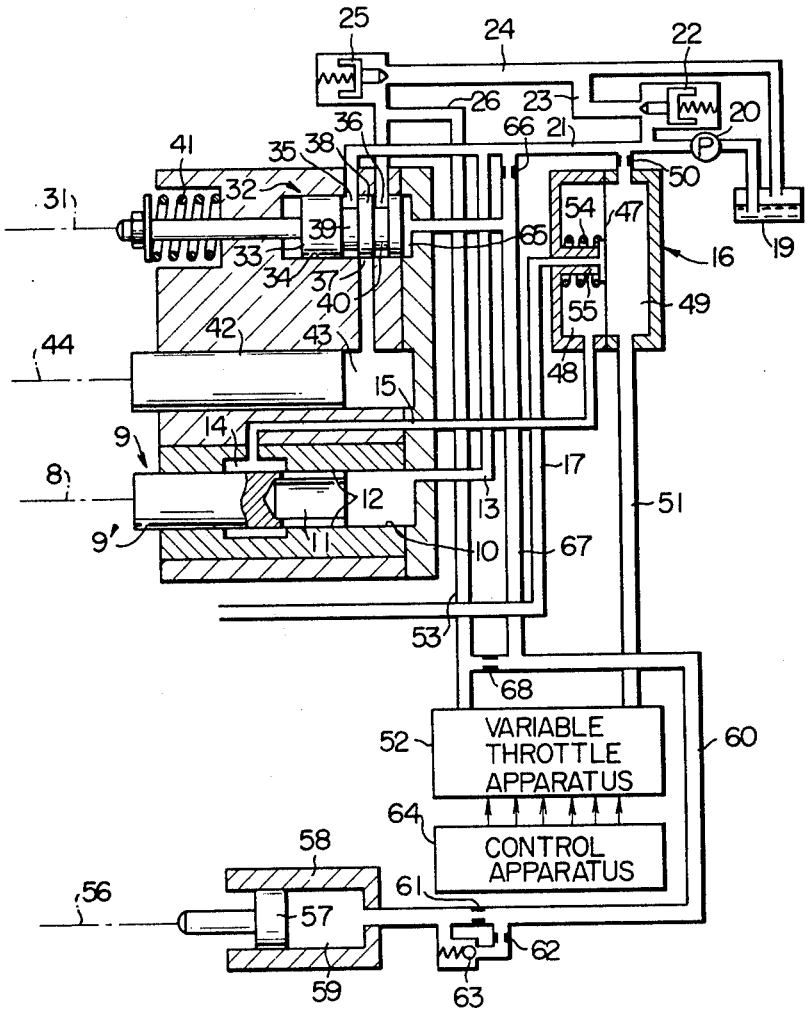
FIGS. 3 and 4 are similar views to FIG. 2 but show further embodiments of the invention.

FIG. 3 shows an embodiment of the invention which is adapted to vary the air-fuel ratio in dependence on variation in the pressure difference Po−Pa. Referring to this figure, a pilot pressure chamber 65 is defined at the right end portion of the bore 34 of the pilot valve 32, i.e. at the righthand side of the spool 33. The pilot pressure chamber 65 is communicated with the high pressure fuel source 21 through a fixed orifice 66 on one hand and communicated with the conduit 53 through a conduit 67 having a fixed orifice 68 on the other hand, the passage 53 serving to interconnect the variable throttle apparatus 52 and the low pressure fuel source 26 to each other. A variable volume chamber 59 of a similar construction as the one shown in FIG. 2 is communicated with the conduit 67. So long as the variable volume chamber remains inoperative, the pressure prevailing in the pilot pressure chamber 65 will be at a constant intermediate level between those of the pressures prevailing in the high pressure fuel source 21 and the low pressure fuel source 26. Consequently, the air valve 3 is so controlled as to maintain the pressure in the air pressure chamber 7 constantly at a preset level.

When the volume of the variable volume chamber 59 is increased in dependence on the acceleration of the engine, a portion of the fuel quantity flowing through the conduit 67 is drawn into the variable volume chamber 59, resulting in a correspondingly reduced pressure in the pilot pressure chamber 65. Consequently, the spool 33 is caused to move rightwards, as viewed in the drawing, whereby the fuel at high pressure flows into the cylinder 43 to move the air valve drive position 42 to the left. Thus, the air valve 3 is rotated in the sense to increase the opening degree thereof. Under these conditions, the pressure Pa in the air pressure chamber 7 is increased thereby to decrease the pressure difference Po−Pa, which results in an increase in the fuel concentration of the air-fuel mixture.

On the other hand, when the volume of the variable volume chamber 59 is decreased during deceleration of the engine, the pressure in the pilot pressure chamber 65 is increased to move the spool 33 to the left, which causes the pressure in the cylinder 43 to be transferred to the low pressure fuel source 26. Then, the air valve drive piston 42 is caused to move rightwards thereby to decrease the opening degree of the air valve 3. Consequently, the pressure Pa prevailing in the air pressure chamber 7 is lowered to increase correspondingly the pressure difference Po−Pa, which in turn involves correspondingly reduced fuel concentration. The variable throttle apparatus 52 is of the similar construction as the one shown in FIG. 2 and serves for the correction of the air-fuel ratio during the normal steady operation of the engine by modifying the pressure in the second pressure chamber 49 of the fuel pressure differential apparatus 16 in dependence on changes in the parameters representing the environmental and operating conditions of the engine, such as those described above.

Figure 4:
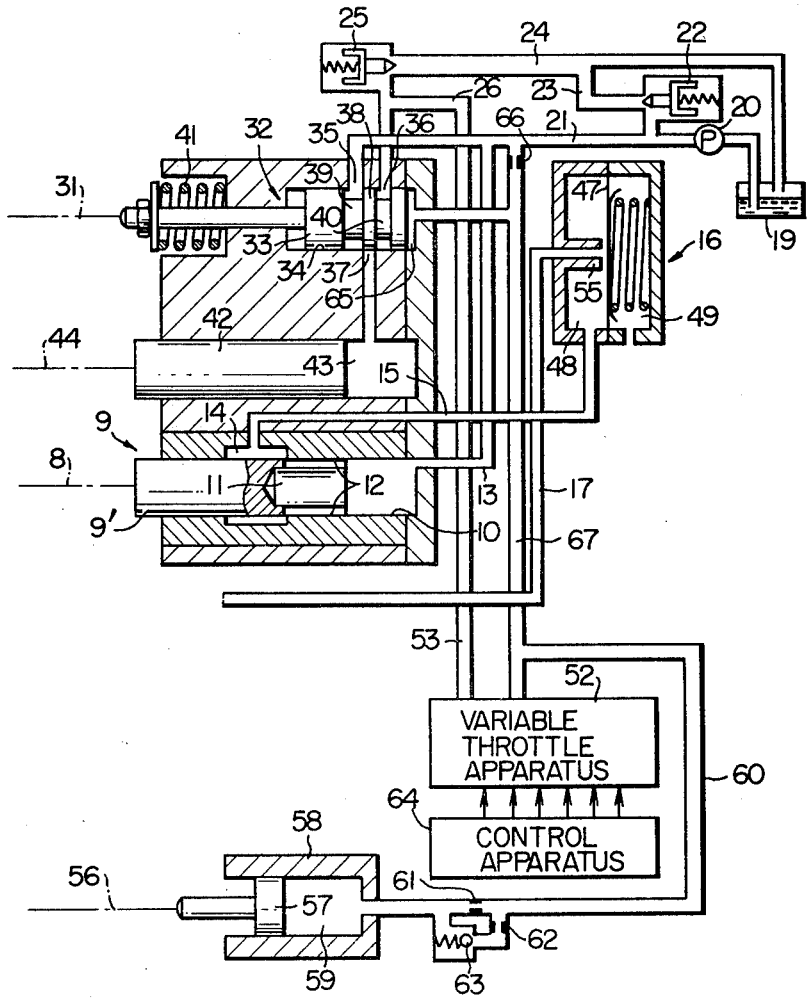

FIG. 4 shows a modification of the arrangement shown in FIG. 3 which differs from the latter in that the conduit 67 communicated with the variable volume chamber 59 is connected to the variable throttle apparatus 52, whereby the pilot pressure chamber 65 is communicated with the low pressure fuel source 26 through the conduit 67, the variable throttle apparatus 52 and the conduit 53. In the case of this embodiment shown in FIG. 4, the second pressure chamber 49 of the fuel pressure differential apparatus 16 is constantly maintained at the atmospheric pressure and takes no part in correcting the air-fuel ratio. Instead, the air-fuel ratio correction effected by the variable throttle apparatus 52 during the normal steady operation of the engine as well as the air-fuel ratio control effected by the variable volume chamber 59 is ultimately accomplished through the control of pressure in the pilot pressure chamber 65.

As will be appreciated from the foregoing description, the present invention has now provided an improved fuel supply apparatus for an internal combustion engine which is capable of variably controlling or adjusting the air-fuel ratio of air-fuel mixture supplied to the engine during the acceleration and deceleration modes thereof with a relatively simple and inexpensive construction by correspondingly changing the pressure difference across the fuel metering valve preset by the fuel pressure differential apparatus 16 or by correspondingly changing the pressure in the air pressure chamber 7 or pressure difference across the air valve 3 preset by the air valve control apparatus in response to a signal representing a pressure change in the variable volume chamber 59 as caused by the piston 57 interlocked to the throttle valve 4.

What is claimed is:

1. In a fuel supply apparatus for an internal combustion engine, including an intake conduit having a throttle valve disposed therein and an air valve disposed upstream of said throttle valve defining an air pressure chamber therebetween; air valve control means for maintaining the pressure prevailing in said air pressure chamber at a preset value; fuel supply means for supplying fuel to said intake conduit at a constant pressure; metering means for metering fuel in proportion to the opening degree of said air valve; and fuel pressure differential means for maintaining the pressure difference produced in said fuel metering means at a preset value; the improvement comprising pressure signal generating means for generating a pressure signal corresponding to the operation of said throttle valve, said pressure signal generating means comprising a cylinder having a piston interlocked with said throttle valve and slidable within said cylinder so that a variable volume chamber is defined within said cylinder; and pressure signal response means for acting in response to the level of said pressure signal for automatically controlling the air-fuel ratio during acceleration and deceleration of the engine, said fuel pressure differential means includes a first pressure chamber for receiving the pressure downstream of said fuel metering means, a second pressure chamber maintained at a predetermined pressure and a constant differential pressure valve downstream of said fuel metering means, said constant differential pressure valve being activated in response to pressure differences between said first and second pressure chamber to control the pressure downstream of said fuel metering means so as to maintain said pressure difference between said first and second pressure chambers constant, and wherein said variable volume chamber is communicated with said second pressure chamber through a fixed orifice and a series connection in parallel therewith, said series connection including a second fixed orifice and a check valve for preventing fluid flow from said variable valve chamber to said second pressure chamber.

2. In a fuel supply apparatus for an internal combustion engine, including an intake conduit having a throttle valve disposed therein and an air valve disposed upstream of said throttle valve defining an air pressure chamber at a preset value; fuel supply means for supplying fuel to said intake conduit at a constant pressure; metering means for metering fuel in proportion to the opening degree of said air valve; and fuel pressure differential means for maintaining the pressure difference produced in said fuel metering means at a preset value; the improvement comprising pressure signal generating means for generating a pressure signal corresponding to the operation of said throttle valve; said pressure signal generating means comprising a cylinder having a piston interlocked with said throttle valve and slidable within said cylinder so that a variable volume chamber is defined within said cylinder; and pressure signal response means for acting in response to the level of said pressure signal for automatically controlling the air-fuel ratio during acceleration and deceleration of the engine wherein said fuel pressure differential means includes a housing, a movable wall disposed within said housing to define a first pressure chamber and a second pressure chamber therein, said first pressure chamber receiving the pressure downstream of said fuel metering means, said second pressure chamber being maintained at a predetermined pressure, a spring for urging said movable wall towards said second pressure chamber, and a constant differential pressure valve operatively connected to said movable wall to respond to pressure differences between said first and second pressure chambers to control the pressure downstream of said fuel metering means so as to maintain said pressure difference between said first and second pressure chambers constant, and wherein said variable volume chamber is communicated with said second pressure chamber, and wherein said variable volume chamber is communicated with said second pressure chamber through a fixed orifice and a series connection in parallel therewith, said series connection including a second fixed orifice and a check valve for preventing fluid flow from said variable valve chamber to said second pressure chamber.

3. In a fuel supply apparatus for an internal combustion engine, including an intake conduit having a throttle valve disposed therein and an air valve disposed upstream of said throttle valve defining an air pressure chamber therebetween; air valve control means for maintaining the pressure prevailing in said air pressure chamber at a preset value; fuel supply means for supplying fuel to said intake conduit at a constant pressure; metering means for metering fuel in proportion to the opening degree of said air valve; and fuel pressure differential means for maintaining the pressure difference produced in said fuel metering means at a preset value; the improvement comprising pressure signal generating means for generating a pressure signal corresponding to the operation of said throttle valve, said pressure signal generating means comprising a cylinder having a piston interlocked with said throttle valve and slidable within said cylinder so that a variable volume chamber is defined within said cylinder; and pressure signal response means for acting in response to the level of said pressure signal for automatically controlling the air-fuel ratio during acceleration and deceleration of the engine wherein said air valve control means comprises a pilot valve operated in response to change in pressure within said air pressure chamber, fluid actuator means operated through fluid pressure controlled by said pilot valve for controlling said air valve so as to cancel the deviation of pressure within said air pressure chamber from said preset pressure, and a pilot pressure chamber communicated with a constant pressure source for urging said pilot valve toward one direction, and wherein said variable volume chamber is communicated with said pilot pressure chamber, wherein said variable volume chamber is communicated with said pilot pressure chamber through a fixed orifice and a series connection in parallel with said fixed orifice, said series connection including a second fixed orifice and a check valve for preventing the fluid flow from said variable volume chamber to said pilot pressure chamber.

4. A fuel supply apparatus as set forth in claim 3, wherein said pilot pressure chamber is communicated with a constant high pressure source through a fixed orifice and communicated with a constant low pressure source through a fixed orifice.

5. A fuel supply apparatus as set forth in claim 3, wherein said pilot pressure chamber is communicated with a constant high pressure source through a fixed orifice and communicated with a constant low pressure source through variable throttle means for controlling the fluid communication between said pilot pressure chamber and said low pressure source in response to environmental and/or operating conditions of the internal combustion engine.

* * * * *